US012065228B2

(12) United States Patent
Jiao et al.

(10) Patent No.: US 12,065,228 B2
(45) Date of Patent: Aug. 20, 2024

(54) HAIRTAIL-IMITATING HIGH-SPEED SOFT ROBOT DRIVEN BASED ON CHEMICAL EXERGONIC REACTION

(71) Applicant: ZHEJIANG UNIVERSITY, Zhejiang (CN)

(72) Inventors: Pengcheng Jiao, Zhejiang (CN); Haipeng Wang, Zhejiang (CN); Yang Yang, Zhejiang (CN); Zhiguo He, Zhejiang (CN)

(73) Assignee: ZHEJIANG UNIVERSITY, Zhejiang (CN)

( * ) Notice: Subject to any disclaimer, the term of this patent is extended or adjusted under 35 U.S.C. 154(b) by 418 days.

(21) Appl. No.: 17/611,182

(22) PCT Filed: May 27, 2021

(86) PCT No.: PCT/CN2021/096232
§ 371 (c)(1),
(2) Date: Nov. 15, 2021

(87) PCT Pub. No.: WO2021/258976
PCT Pub. Date: Dec. 30, 2021

(65) Prior Publication Data

US 2022/0306255 A1 Sep. 29, 2022

(30) Foreign Application Priority Data

Jun. 24, 2020 (CN) ..... 202010589341.2

(51) Int. Cl.

| | |
|---|---|
| ***B63H 1/36*** | (2006.01) |
| ***B63G 8/00*** | (2006.01) |
| ***B63G 8/22*** | (2006.01) |

(52) U.S. Cl.
CPC ..... *B63H 1/36* (2013.01); *B63G 8/001* (2013.01); *B63G 8/22* (2013.01)

(58) Field of Classification Search
CPC ..... B63H 1/36; B63G 8/001; B63G 8/22
See application file for complete search history.

(56) References Cited

FOREIGN PATENT DOCUMENTS

| | | |
|---|---|---|
| CN | 104015904 | 9/2014 |
| CN | 108357654 | 8/2018 |

(Continued)

OTHER PUBLICATIONS

"International Search Report (Form PCT/ISA/210) of PCT/CN2021/096232," mailed on Sep. 1, 2021, pp. 1-5.

(Continued)

*Primary Examiner* — S. Joseph Morano
*Assistant Examiner* — Jovon E Hayes
(74) *Attorney, Agent, or Firm* — JCIP GLOBAL INC.

(57) ABSTRACT

A hairtail-imitating high-speed soft robot driven based on chemical exergonic reaction, including a fish head module, a fish body module and a fishtail module; wherein the fish head module includes a fish head shell, the fish head shell is internally provided with a rigid exergonic reaction bin, a combustible agent storage unit, a combustion promoter storage unit, and an exergonic reaction excitation device, and a rigid push plate is in sliding fit in the rigid exergonic reaction bin; the fish body module includes a flexible fishbone, restraint assemblies, and flexible fish skin; and the fishtail module includes a fishtail fixing block.

10 Claims, 3 Drawing Sheets

(56) References Cited

FOREIGN PATENT DOCUMENTS

| | | | | | |
|---|---|---|---|---|---|
| CN | 109131797 | | 1/2019 | | |
| CN | 109131797 | A * | 1/2019 | ..... | B63C 11/52 |
| CN | 109941415 | | 6/2019 | | |
| CN | 109941415 | A * | 6/2019 | ..... | B63C 11/52 |
| CN | 111806662 | | 10/2020 | | |
| JP | 2008018794 | | 1/2008 | | |
| JP | 2008018794 | A * | 1/2008 | ..... | B63C 11/52 |

OTHER PUBLICATIONS

"Written Opinion of the International Searching Authority (Form PCT/ISA/237) of PCT/CN2021/096232," mailed on Sep. 1, 2021, pp. 1-4.

* cited by examiner

HAIRTAIL-IMITATING HIGH-SPEED SOFT ROBOT DRIVEN BASED ON CHEMICAL EXERGONIC REACTION

CROSS-REFERENCE TO RELATED APPLICATION

This application is a 371 of international application of PCT application serial no. PCT/CN2021/096232, filed on May 27, 2021, which claims the priority benefit of China application no. 202010589341.2, filed on Jun. 24, 2020. The entirety of each of the above-mentioned patent applications is hereby incorporated by reference herein and made a part of this specification.

BACKGROUND

Technical Field

The present invention belongs to the field of soft robots, and in particular relates to a hairtail-imitating high-speed soft robot driven based on chemical exergonic reaction.

Description of Related Art

A traditional rigid robot has the defects of large volume, high weight, large noise, poor environment adaptability and the like. To this end, a soft robot is gradually developed as a novel intelligent robot for improving the defects. The soft robot specifically refers to intelligent execution equipment which is partially or completely made of flexible materials and has controllable actions. The soft robot has flexible motion potential and bionic potential closer to the biological action. At present, the soft robot is mainly composed of a shape memory material, a dielectric elastomeric material, a piezoelectric ceramic material, a corresponding hydrogel material, and a common flexible material combined with a special driving method, which may control and respond to physical information such as temperature, current, pressure and magnetic field. The existing soft robot has the defects that a fast and large driving force cannot be generated, and thus the team of the inventor puts forward a driving approach using chemical exergonic reaction, the driving approach can generate at least 10 times higher driving force than other soft robot driving approaches within a particularly short time; and the phenomenon is defined as an instantaneous variable speed driving method. Meanwhile, the team of the inventor carries out the research by combining a post-buckling phenomenon of a plate material, and provides a hairtail-imitating high-speed soft robot driven based on chemical exergonic reaction.

SUMMARY

To overcome the defects of the prior art, the present invention provides a hairtail-imitating high-speed soft robot driven based on chemical exergonic reaction.

The hairtail-imitating high-speed soft robot driven based on chemical exergonic reaction comprises:

a fish head module, the fish head module comprising a fish head shell, wherein the fish head shell is internally provided with a rigid exergonic reaction bin, a combustible agent storage unit for injecting combustible gas into the rigid exergonic reaction bin, a combustion promoter storage unit for injecting an accelerant into the rigid exergonic reaction bin, and an exergonic excitation device for exciting chemical exergonic reaction in the rigid exergonic reaction bin, and a rigid push plate is in sliding fit in the rigid exergonic reaction bin;

a fish body module, the fish body module comprising a flexible fishbone connected to the rigid push plate in a matched mode, restraint assemblies arranged at two sides of the flexible fishbone, and flexible fish skin wrapping the flexible fishbone and the restraint assemblies, wherein front ends of the restraint assemblies are connected to the fish head shell, and the flexible fishbone can generate a post-buckling phenomenon when rapidly pushed by the rigid push plate;

and a fishtail module, the fishtail module comprising a fishtail fixing block for being connected to the flexible fishbone and rear ends of the restraint assemblies.

The hairtail-imitating high-speed soft robot driven based on chemical exergonic reaction is provided, wherein the constraint assembly comprises a plurality of transmission parts hinged in sequence.

The hairtail-imitating high-speed soft robot driven based on chemical exergonic reaction is provided, wherein each transmission part comprises a deformation auxiliary block, a hinge shaft arranged at one end of the deformation auxiliary block, and a hinge sleeve arranged at the other end of the deformation auxiliary block; and the adjacent transmission parts are hinged through the running fit of the hinge sleeve and the hinge shaft—corresponding to each other.

The hairtail-imitating high-speed soft robot driven based on chemical exergonic reaction is provided, wherein the flexible fish skin can simultaneously generate a post-buckling phenomenon along with the flexible fishbone through the deformation auxiliary block, and then the flexible fish skin can be deformed to an initial state due to elastic recovery.

The hairtail-imitating high-speed soft robot driven based on chemical exergonic reaction is provided, wherein a post-buckling reaction module is composed of the fishbone fixing block and the rigid push plate, and the fishbone fixing block and a side wall of the fish head shell provide fixed restraint for the occurrence of the post-buckling phenomenon.

The hairtail-imitating high-speed soft robot driven based on chemical exergonic reaction is provided, wherein the fish head shell is further internally provided with a head control bin, the combustible agent storage unit, the combustion promoter storage unit and the exergonic reaction excitation device are all arranged in the head control bin.

The hairtail-imitating high-speed soft robot driven based on chemical exergonic reaction is provided, wherein the fish head shell is provided with a bionic swim bladder and a bionic gill, both of which control the buoyancy of the robot through water absorption or drainage.

The hairtail-imitating high-speed soft robot driven based on chemical exergonic reaction is provided, wherein the fish head shell is provided with an optical imaging module for detection.

The hairtail-imitating high-speed soft robot driven based on chemical exergonic reaction is provided, wherein the fishtail module further comprises a fishtail imitation piece arranged outside the fishtail fixing block.

The hairtail-imitating high-speed soft robot driven based on chemical exergonic reaction is provided, wherein the flexible fishbone gradually decreases in longitudinal cross-sectional area from front to back.

A hairtail-imitating high-speed soft robot driven based on chemical exergonic reaction driven by the chemical exergonic reaction provided by the present invention can convert instantaneous high-energy chemical exergonic reaction into multi-mode post-buckling deformation, and high-speed tail swinging is achieved by releasing elastic potential energy stored when the flexible fishbone generates the post-buckling deformation, thus achieving the purpose of instantaneous acceleration of the underwater soft robot. The robot has the advantages of high flexibility, environment suitability, light mass, low manufacturing cost, low driving consumption and the like, and a deformation mode of the post-buckling can be controlled based on different chemical exergonic reaction degrees, in other words, different fish-tailing actions can be achieved for different exergonic degrees. By means of the design, the defect of the field that an underwater soft robot is low in driving capacity is overcome, and meanwhile, the functions of underwater instantaneous variable-speed starting, braking, steering, catching, striking and the like can be achieved; in addition, by changing a structural design of the flexible fishbone, the expected deformation of the mode can be changed according to different driving demands, and therefore the practicability of the design is greatly improved.

DESCRIPTION OF THE EMBODIMENTS

Figure 1:
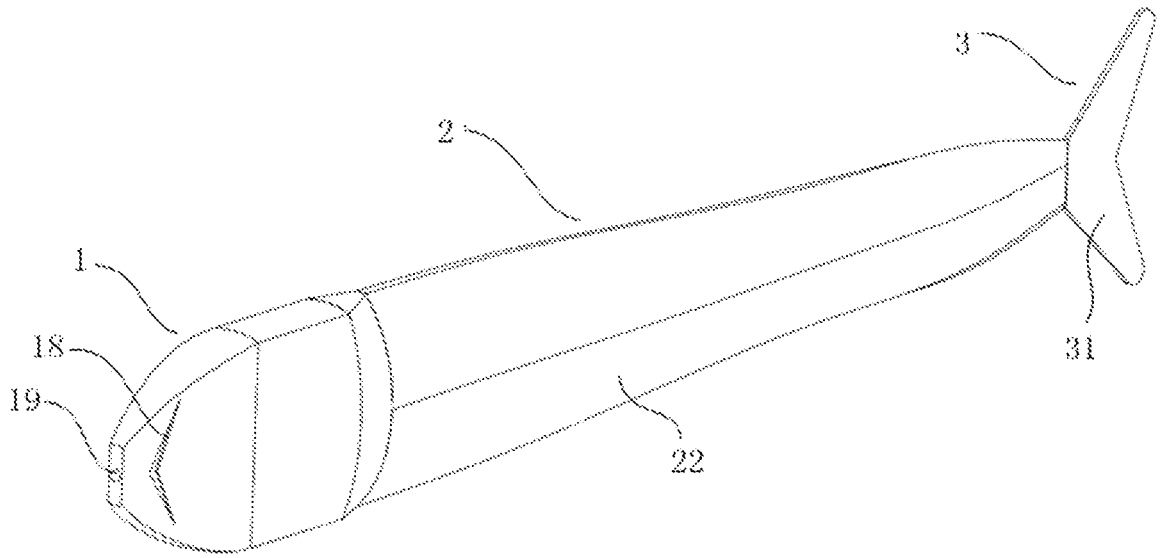
FIG. 1 is a first diagram of an external structure in accordance with the present invention.

The present invention is further described below in conjunction with the accompanying drawings.

As shown in the FIGs, a hairtail-imitating high-speed soft robot driven based on chemical exergonic reaction comprises:

a fish head module 1, the fish head module 1 comprising a fish head shell 10, wherein the fish head shell 10 is internally provided with a rigid exergonic reaction bin 11, a combustible agent storage unit 12 for injecting combustible gas into the rigid exergonic reaction bin 11, a combustion promoter storage unit 13 for injecting an accelerant into the rigid exergonic reaction bin 11, and an exergonic excitation device 14 for exciting chemical exergonic reaction in the rigid exergonic reaction bin 11, and a rigid push plate 15 is in sliding fit in the rigid exergonic reaction bin 11;

a fish body module 2, the fish body module 2 comprising a flexible fishbone 20 connected to the rigid push plate 15 in a matched mode, restraint assemblies 21 arranged at two sides of the flexible fishbone 20, and flexible fish skin 22 wrapping the flexible fishbone 20 and the restraint assemblies 21, wherein front ends of the restraint assemblies 21 are connected to the fish head shell 10, and the flexible fishbone 20 can generate a post-buckling phenomenon when rapidly pushed by the rigid push plate 15;

and a fishtail module 3, the fishtail module 3 comprising a fishtail fixing block 30 for being connected to the flexible fishbone 20 and rear ends of the restraint assemblies 21.

Preferably, the constraint assembly 21 comprises a plurality of transmission parts hinged in sequence.

In above structure, each transmission part comprises a deformation auxiliary block 210, a hinge shaft 211 arranged at one end of the deformation auxiliary block 210, and a hinge sleeve 212 arranged at the other end of the deformation auxiliary block 210, and the adjacent transmission parts are hinged through the running fit of the hinge sleeve 212 and the hinge shaft 211 corresponding to each other. Specifically, the cross section of the hinge sleeve 212 is of an arc structure, the arc structure has an arc range of 180-270 degrees and is capable of wrapping the hinge shaft 211 inserted.

In above structure, the flexible fish skin 22 can simultaneously generate a post-buckling phenomenon along with the flexible fishbone 20 through the deformation auxiliary block 210, and then the flexible fish skin can be deformed to an initial state due to elastic recovery.

In above structure, a post-buckling reaction module is composed of the fishbone fixing block 30 and the rigid push plate 15, and the fishbone fixing block 30 and a side wall of the fish head shell 10 provide fixed restraint for the occurrence of the post-buckling phenomenon.

Preferably, the fish head shell 10 is further internally provided with a head control bin 16, the combustible agent storage unit 12, the combustion promoter storage unit 13 and the exergonic reaction excitation device 14 are all arranged in the head control bin 16.

Preferably, the fish head shell 10 is provided with a bionic swim bladder 17 and a bionic gill 18, both of which control the buoyancy of the robot through water absorption or drainage. Specifically, the bionic gill 18 is a drainage port capable of being automatically opened and closed, the bionic swim bladder 17 is a water sump, both of which can adjust the buoyancy of the robot by means of the submarine drainage principle and are well-known technologies.

Preferably, the fish head shell 10 is provided with an optical imaging module 19 for detection, and the optical imaging module 19 is used for detection.

Preferably, the fishtail module 3 further comprises a fishtail imitation piece 31 arranged outside the fishtail fixing block 30. Specifically, the fishtail imitation piece 31 and the fish skin 22 shell are integrally designed.

Preferably, the flexible fishbone 20 gradually decreases in longitudinal cross-sectional area from front to back.

Preferably, the exergonic reaction excitation device 14 may be an electric spark generator.

It should be noted that a flexible structure of the present invention can be made of flexible materials such as flexible silica gel, flexible rubber, and the like.

Figure 2:
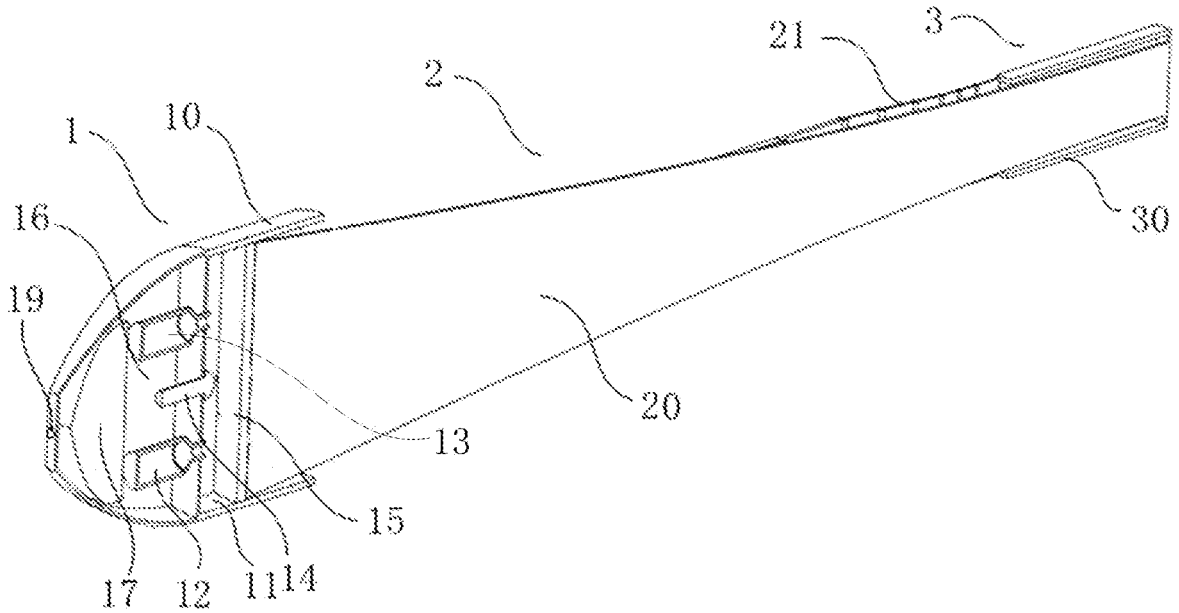
FIG. 2 is a diagram of an internal structure in accordance with the present invention.
Figure 3:
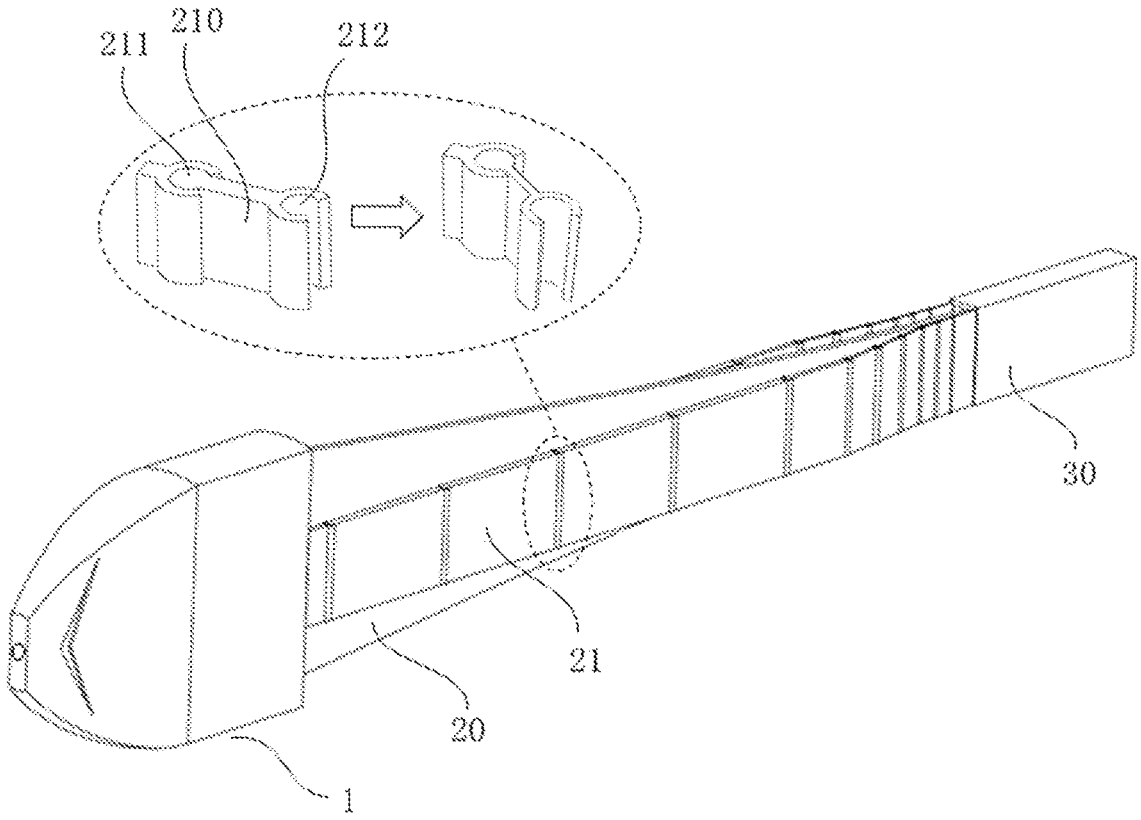
FIG. 3 is a first structure diagram in accordance with the present invention when flexible fish skin and a fishtail imitation piece are removed, where the present invention is in an undriven state.

A working principle at a driving preparation stage of the soft robot is explained by taking FIG. 1, FIG. 2 and FIG. 3 as examples, when the driving preparation process is started, the combustible agent storage unit 12 and the combustion promoter storage unit 13 in the heat control bin 16 are controlled to simultaneously inject combustible gas (such as alkane gas) and combustion promoter (such as oxygen) into the rigid exergonic reaction bin 11, and are controlled to be closed after gas injection is completed, and the exergonic reaction excitation device 14 is excited at the predicted time; and electric sparks generated by the exergonic reaction excitation device 14 can instantaneously excite the chemical exergonic reaction in the rigid reaction bin 11. When the reaction occurs, extremely high internal pressure may be generated within extremely short time to push the rigid push plate 15 to displace towards the tail, and a front portion and a rear portion of the flexible fishbone 20 are fixed to the rigid push plate 15 and the fishbone fixing block 30 respectively, that is, when the rigid push plate 15 is displaced, the pressure is applied to the flexible fishbone 20 to make the flexible fishbone generate a post-buckling phenomenon, and the post-buckling phenomenon can generate deformations of different modes according to different applied pressure. Meanwhile, due to the fact that the shape of the flexible fishbone 20 is wide in front and narrow in rear, when the post-buckling phenomenon occurs, the severe deformation position should be at the tail, thus facilitating violent fishtailing of the soft robot in motion. Meanwhile, in order to adjust the buoyancy of the robot, the bionic fish gill 18 can be opened and closed according to conditions, thus sucking surrounding water into the bionic swim bladder 17 or discharging water stored in the bionic swim bladder 17 through the bionic fish gill 18.

Figure 4:
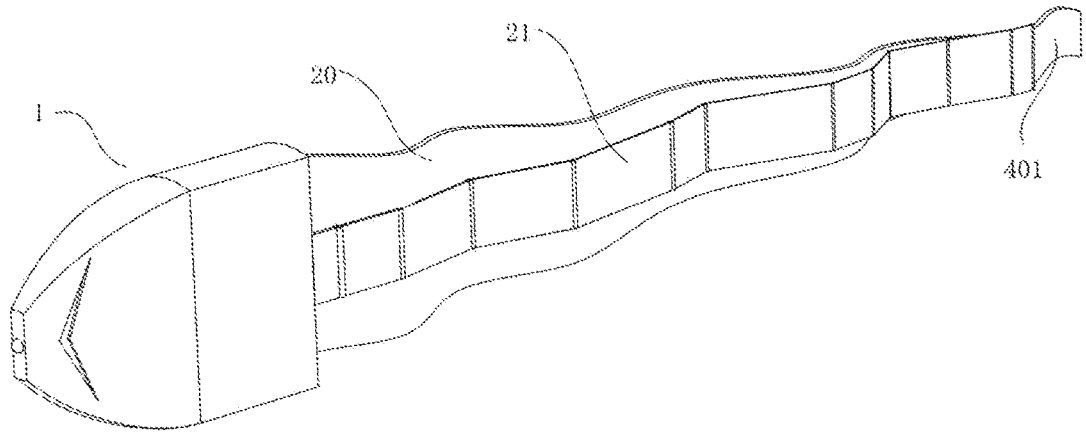
FIG. 4 is a second structure diagram in accordance with the present invention when flexible fish skin and a fishtail imitation piece are removed, where the present invention is in a driving state.
Figure 5:
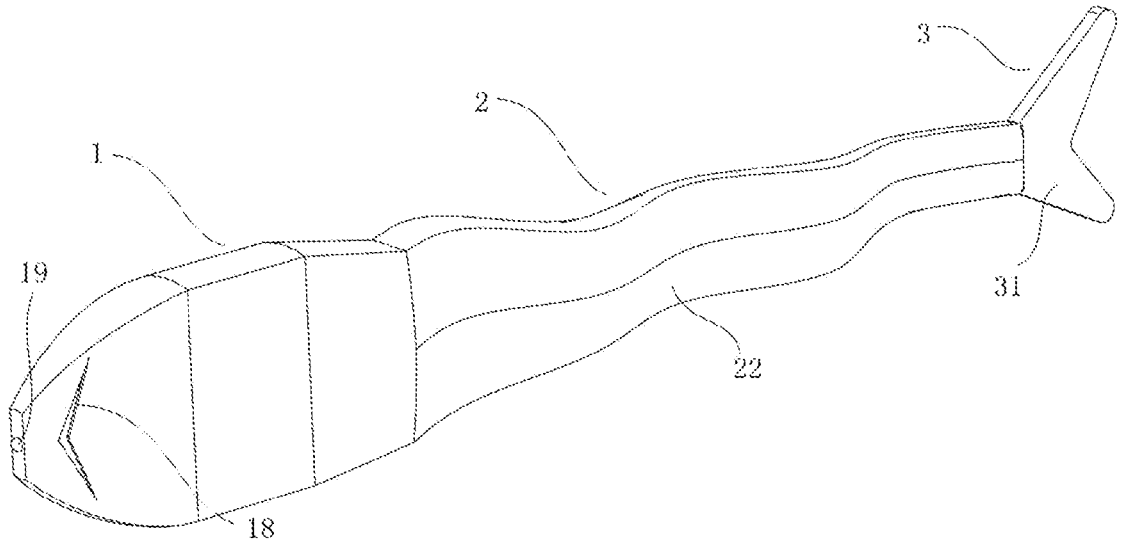
FIG. 5 is a second diagram of an external structure in accordance with the present invention, where the present invention is in a driving state.

A working principle in the driving process of the soft robot is explained by taking FIG. 2, FIG. 4, and FIG. 5 as examples, when the flexible fishbone 20 generates the post-buckling phenomenon, a deformed boundary of the flexible fishbone is acted on the deformation auxiliary block 210, and the deformation similar to that of the flexible fishbone 20 is transferred to the flexible fish skin 22 through the hinge shafts 211 and the hinge sleeves 212. Due to the fact that the generation speed of the chemical exergonic reaction is far higher than the material response speed, after the post-buckling phenomenon completely generates, the flexible fish skin 22 is rapidly deformed from a post-buckling state to an initial state, and during the process, the flexible fish skin 22 can releases elastic potential energy to cause a high-speed fishtailing phenomenon, and the phenomenon may push surrounding water to enable the soft robot to swim forwards.

Finally, it should be noted that the above embodiments are merely illustrative of the technical solutions of the present invention, and are not intended to limit the same. Although the present invention has been described in detail with reference to the foregoing embodiments, it should be understood by those of ordinary skill in the art that modification may be made to the technical solutions described in the foregoing embodiments, or equivalent replacement may be made to some or all of the technical features; and the modifications or replacements do not make the essence of the corresponding technical solutions deviate from the scope of the technical solutions of various embodiments of the present invention.

What is claimed is:

1. A hairtail-imitating robot driven based on chemical exergonic reaction, comprising:

a fish head module, the fish head module comprising a fish head shell, wherein the fish head shell is internally provided with a rigid exergonic reaction bin, a combustible agent storage unit for injecting combustible gas into the rigid exergonic reaction bin, a combustion promoter storage unit for injecting an accelerant into the rigid exergonic reaction bin, and an exergonic excitation device for exciting chemical exergonic reaction in the rigid exergonic reaction bin, and a rigid push plate is in sliding fit in the rigid exergonic reaction bin;

a fish body module, the fish body module comprising a flexible fishbone connected to the rigid push plate in a matched mode, restraint assemblies arranged at two sides of the flexible fishbone, and flexible fish skin wrapping the flexible fishbone and the restraint assemblies, wherein front ends of the restraint assemblies are connected to the fish head shell, and the flexible fishbone is capable of generating a post-buckling phenomenon when rapidly pushed by the rigid push plate;

and a fishtail module, the fishtail module comprising a fishtail fixing block for being connected to the flexible fishbone and rear ends of the restraint assemblies.

2. The hairtail-imitating robot driven based on chemical exergonic reaction according to claim 1, wherein each restraint assembly comprises a plurality of transmission parts hinged in sequence.

3. The hairtail-imitating robot driven based on chemical exergonic reaction according to claim 2, wherein each transmission part comprises a deformation auxiliary block, a hinge shaft arranged at one end of the deformation auxiliary block, and a hinge sleeve arranged at the other end of the deformation auxiliary block; and adjacent transmission parts are hinged through the running fit of the hinge sleeve and the hinge shaft corresponding to each other.

4. The hairtail-imitating robot driven based on chemical exergonic reaction according to claim 3, wherein the flexible fish skin is capable of simultaneously generating a post-buckling phenomenon along with the flexible fishbone through the deformation auxiliary block, and then the flexible fish skin is capable of being deformed to an initial state due to elastic recovery.

5. The hairtail-imitating robot driven based on chemical exergonic reaction according to claim 4, wherein a post-buckling reaction module is composed of the fishbone fixing block and the rigid push plate, and the fishbone fixing block and a side wall of the fish head shell provide fixed restraint for the occurrence of the post-buckling phenomenon.

6. The hairtail-imitating robot driven based on chemical exergonic reaction according to claim 1, wherein the fish head shell is further internally provided with a head control bin, the combustible agent storage unit, the combustion promoter storage unit and the exergonic reaction excitation device are all arranged in the head control bin.

7. The hairtail-imitating robot driven based on chemical exergonic reaction according to claim 1, wherein the fish head shell is provided with a bionic swim bladder and a bionic gill, both of which control the buoyancy of the robot through water absorption or drainage.

8. The hairtail-imitating robot driven based on chemical exergonic reaction according to claim 1, wherein the fish head shell is provided with an optical imaging module for detection.

9. The hairtail-imitating robot driven based on chemical exergonic reaction according to claim 1, wherein the fishtail module further comprises a fishtail imitation piece arranged outside the fishtail fixing block.

10. The hairtail-imitating robot driven based on chemical exergonic reaction according to claim 1, wherein the flexible fishbone gradually decreases in longitudinal cross-sectional area from front to back.

* * * * *